US010252566B2

(12) United States Patent
McAtee

(10) Patent No.: US 10,252,566 B2
(45) **Date of Patent: *Apr. 9, 2019**

(54) COMMUNICATION SYSTEMS AND KITS

(71) Applicant: INSIGNIA MARKETING, INC., The Woodlands, TX (US)

(72) Inventor: Christine M. McAtee, Magnolia, TX (US)

(73) Assignee: Insignia Marketing, Inc., The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/836,139

(22) Filed: Dec. 8, 2017

(65) Prior Publication Data

US 2018/0099523 A1 Apr. 12, 2018

Related U.S. Application Data

(63) Continuation of application No. 13/372,663, filed on Feb. 14, 2012, now Pat. No. 9,873,286.

(51) Int. Cl.

| | |
|---|---|
| ***G09F 1/12*** | (2006.01) |
| ***B43L 1/00*** | (2006.01) |
| ***G09F 15/00*** | (2006.01) |
| ***A61G 12/00*** | (2006.01) |
| *A47G 1/06* | (2006.01) |

(52) U.S. Cl.

CPC ..... *B43L 1/00* (2013.01); *A61G 12/00* (2013.01); *G09F 15/00* (2013.01); *G09F 15/0012* (2013.01); *A47G 1/06* (2013.01); *A47G 1/0611* (2013.01); *G09F 1/12* (2013.01); *G09F 15/0018* (2013.01)

(58) Field of Classification Search

CPC ..... B43L 1/00; G09F 15/0018; G09F 1/12; A47G 1/0611; A47G 1/06

USPC ..... 40/791, 776; 206/461, 467, 469, 470

See application file for complete search history.

(56) References Cited

U.S. PATENT DOCUMENTS 4,512,094 A * 4/1985 Seely ..... G09F 15/0018 40/647
4,512,095 A * 4/1985 Seely ..... G09F 15/0018 40/647
4,523,400 A * 6/1985 Seely ..... G09F 15/0018 40/647
4,702,025 A * 10/1987 Mace ..... A47G 1/0611 40/647

(Continued)

*Primary Examiner* — Shin H Kim
(74) *Attorney, Agent, or Firm* — Invention Mine LLC

(57) ABSTRACT

A planar display communication board includes a frame having a plurality of sides, at least one of the plurality of sides includes a cover member hingedly connected to a functional member, the cover member having a raised position and a closed position, and the functional member including a slot and a shelf. A substrate base sheet is held within the slot of the functional member and an erasable sheet is positioned directly over a flexible media sheet and supported by the shelf. When the cover member is in the raised position, the erasable sheet and the flexible media sheet abut for alignment against shelf post extension; and when the cover member is in the closed position, the cover member compresses the erasable sheet and the flexible media sheet against the substrate base sheet away from at least one edge of the erasable sheet and the flexible media sheet.

20 Claims, 9 Drawing Sheets

(56) References Cited

U.S. PATENT DOCUMENTS

| | | | | | |
|---|---|---|---|---|---|
| 4,756,107 | A * | 7/1988 | Hillstrom | B60R 13/00 | 160/378 |
| 4,958,458 | A * | 9/1990 | Hillstrom | A47G 1/0611 | 40/647 |
| 5,815,971 | A * | 10/1998 | Rothe | A47G 1/0611 | 40/718 |
| 5,926,986 | A * | 7/1999 | Dingle | G09F 15/0018 | 267/158 |
| 6,272,779 | B1 * | 8/2001 | Seiber | G09F 7/18 | 248/453 |
| 6,678,982 | B2 * | 1/2004 | Pitcher | G09F 15/0018 | 40/793 |
| 6,854,202 | B1 * | 2/2005 | Ives | G09F 15/0087 | 40/491 |
| 6,865,837 | B2 * | 3/2005 | Matteau | B42F 5/04 | 281/2 |
| 7,354,273 | B2 * | 4/2008 | Donelan | B43L 1/00 | 434/408 |
| 8,091,704 | B2 * | 1/2012 | Trigg | B65D 75/366 | 206/467 |

* cited by examiner

COMMUNICATION SYSTEMS AND KITS

CROSS-REFERENCE TO RELATED APPLICATIONS

This application is a Continuation of U.S. patent application Ser. No. 13/372,663, filed Feb. 14, 2012, entitled "COMMUNICATION SYSTEMS AND KITS," which is hereby incorporated herein by reference in its entirety.

TECHNICAL FIELD

The present disclosure relates generally to the field of communication systems and kits, and more specifically to communication systems and kits including a removable erasable sheet over a media sheet, such as may be used in hospitals and other settings.

BACKGROUND ART

Dry-erase boards have been used for years and are available in different materials. Furthermore, frames with snap closures, such as the known "Trappa" frame, have been available for years. In hospitals and other medical settings, it is desired to have professional looking, yet highly functional communications boards for doctors and other medical personnel to communicate with patients and other professionals.

Often when erasable boards are used, their surfaces become marred by misuse, such as with permanent markers, or by inadequate erasing. This can be problematic and costly for hospitals and other medical settings, or in other settings requiring or desiring communication between people. In boards having a separate erasable material over another sheet, it can be quite difficult to quickly remove the erasable material from the underlying substrate sheet, even if they are not adhered together. In some cases users desire durable, long-lasting media sheets to convey information.

As may be seen, the need remains for a new type of communication board system, particularly for settings mentioned above, that would be much more convenient for medical personnel, and would make communications with patients and other medical personnel more efficient and safer.

SUMMARY

In accordance with the present disclosure, communication systems and/or kits are presented which reduce or overcome one or more of the above shortcomings.

A first system embodiment provides a planar display communication board including a frame having a plurality of sides, at least one of the plurality of sides including a cover member hingedly connected to a functional member, the cover member having a raised position and a closed position, and the functional member including: a slot formed by (i) a top surface of the functional member, (ii) a post extension that extends from the top surface, and (iii) a first surface of a wing that extends from the post extension parallel to the top surface; and a shelf formed by (i) the post extension and (ii) a second surface of the wing, the second surface of the wing opposing the first surface of the wing; a substrate base sheet held within the slot of the functional member; and an erasable sheet positioned directly over a flexible media sheet and supported by the shelf, such that when the cover member is in the raised position, the erasable sheet and the flexible media sheet abut for alignment against the post extension; and when the cover member is in the closed position, the cover member compresses the erasable sheet and the flexible media sheet against the substrate base sheet away from at least one edge of the erasable sheet and the flexible media sheet.

A second system embodiment provides for a planar display communication board kit including a frame having a plurality of sides, at least one of the sides including a cover member hingedly connected to a functional member, the cover member having a raised position and a closed position, and the functional member including a slot formed by (i) a top surface of the functional member, (ii) a post extension that extends from the top surface, and (iii) a first surface of a wing that extends from the post extension parallel to the top surface; and a shelf formed by (i) the post extension and (ii) a second surface of the wing, the second surface of the wing opposing the first surface of the wing; and a substrate base sheet held within the slot of the functional member; such that the communication board kit is configured to receive an erasable sheet positioned over a flexible media sheet; when the cover members are in the raised position, the erasable sheet and the flexible media sheet are supported by the shelf and abut for alignment against the post extension; and when the cover members are in the closed position, the cover member compresses the erasable sheet and the flexible media sheet against the substrate base sheet away from at least one edge of the erasable sheet and the flexible media sheet.

Kits may include other optional items, such as, but not limited to dry- or wet-erase markers, erasers for dry and/or wet erase sheets, a dispenser for lifting tabs, "loose" lifting tabs, sterile and/or disinfectant wipes, and packaging, such as plastic stretch wrapping, bubble wrap packaging enclosing the components so that they may be displayed for sale, or simply for ease in delivery.

Further aspects and advantages of the disclosure will become apparent by reviewing the detailed description, drawings figures, and claims of that follow.

Figure 1:
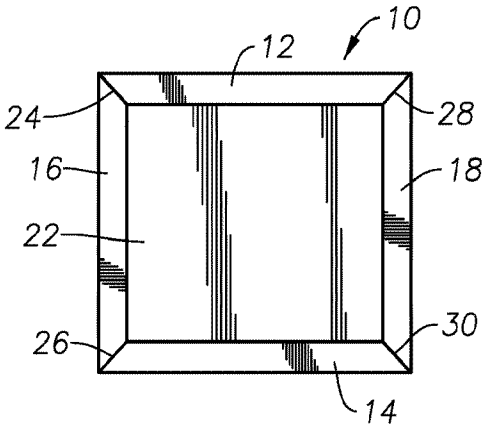
Fig. 1 (Prior Art)
FIGS. 1 and 2 are schematic plan views of two prior art frames suitable for use in the systems and kits of the present disclosure.

It is to be noted, however, that the figures of the appended drawings may not be to scale and illustrate only typical embodiments of this disclosure, and are therefore not to be considered limiting of its scope, for the disclosure may admit to other equally effective embodiments.

DETAILED DESCRIPTION

In the following description, numerous details are set forth to provide an understanding of the disclosed methods and kits. However, it will be understood by those skilled in the art that the systems and kits may be practiced without these details and that numerous variations or modifications from the specifically described embodiments may be possible and are deemed within the claims or claimable subject matter in this or subsequent patents. All United States (U.S.) published patent applications and U.S. patents referenced herein are hereby explicitly incorporated herein by reference. In the event definitions of terms in the referenced patents and applications conflict with how those terms are defined in the present application, the definitions for those terms that are provided in the present application shall be deemed controlling.

The present disclosure relates generally to communication systems, particularly, but not limited to, communications systems for hospitals, although the disclosure is not so limited. While the following detailed description describes features primarily associated with communications boards for hospitals, those skilled in the communications art will realize that with no or simple modifications the specifically described systems and kits herein may be employed in a variety of uses.

Certain system embodiments of the present disclosure may be characterized as customizable communication boards, such as patient rounding boards. Patient care quality concerns related to medical rounding boards may benefit from improved communications and efficient processes to better equip healthcare personnel regarding the care of the patient. In accordance with certain embodiments of the present disclosure, a customizable patient rounding board may provide for improved patient/healthcare personnel communications and allow for personalized medical care. Furthermore, customizable patient rounding boardsystems of the present disclosure may allow for more durable, longer-lasting assemblies.

As used herein the phrase "durable, long-lasting" means that either the printing ink, the media sheet material itself, or both, will be such as to enable the media sheet to withstand at least one year of continued use, maintaining its appearance substantially (non-fading or substantially so) the same during that year without necessity of the media sheet being changed out. This has been identified by the inventor herein as a highly desirable feature of media sheets in certain end uses of certain systems and kits described herein. While the inventor herein is not an expert in printing technology, it is known that companies such as Hewlett-Packard (HP) would define "durable, long-lasting" using the terms "permanence" and "durability." "Permanence" according to HP refers to how well a printed image lasts over time—whether it fades when exposed to sunlight, heat, humidity or airborne pollutants. "Durability" according to HP refers to how well an image resists accidents—such as spilled water, smudging and fingernail scratches. Durable, long-lasting media sheets useful in the present systems and kits should meet permanence and durability tests developed at least by standard setting organizations or independent test labs. See for example ISO 11798 (permanence and durability of writing, printing and copying on paper—requirements and test methods) and ISO 18909 (for color photographs). Useful inks may include those described in U.S. Pat. Nos. 7,478,903, 7,188,943, 7,169,218, 7,105,045, and 6,682,589. Despite these durability features, note that the media sheets may be quickly and easily changed as desired (in other words, the existing media sheet removed and an identical or non-identical media inserted).

One particularly identified embodiment comprises a frame (in certain embodiments rectangular, although not necessarily so, as triangular, trapezoidal, and the like may be contemplated), a substrate base sheet held by the frame, a media sheet held by the frame, the media sheet having a length and width, a substantially transparent erasable sheet (dry- or wet-erasable) having substantially same length and width as the media sheet, the erasable sheet positioned directly over the media sheet and supported by the frame at locations substantially the same as where the frame supports the media sheet, and at least one of the media sheet and erasable sheet having at least one lifting tab extending away from a peripheral edge thereof.

In certain system embodiments the frame may comprise four spring-loaded sides forming a rectangle, each side comprising a cover member hingedly connected to a functional member, and at least one spring that causes the cover member to snap closed over the functional member when closed, the cover member having a ridge that holds the erasable sheet and the media sheet against the substrate base sheet at locations away from edges of the erasable and media sheets, the functional member having a slot for accepting an edge of the substrate sheet, and a shelf for supporting the media sheet and the erasable sheet. In certain other systems, the frame may be a "slideable entry" frame, wherein the erasable and media sheets may be slid into and out of a side of the frame, through a slot for example. In such frames a lifting tab may be exposed (viewable) or hidden behind a recessed portion of the frame side. Finally, certain embodiments may not comprise a frame at all, but may employ magnets, hook and loop fasteners (such as known under the trade designation VELCRO), and the like, to hang media and erasable sheets on a wall or other structure, with or without durable, long-lasting media sheets, and with or without one or more lifting tabs.

In certain system embodiments, the lifting tab may be integral with either the erasable sheet, the media sheet or both.

In certain other system embodiments the lifting tab may be non-integral with but adhered to either the erasable sheet, the media sheet or both.

In certain system embodiments the lifting tab may comprise a first portion and a second portion, the first portion of the lifting tab adhered to an underside of the erasable sheet, the second portion not adhered or connected in any way to the erasable sheet.

In yet other system embodiments the lifting tab second portion may be foldable over a top surface of the erasable sheet.

In certain other system embodiments the lifting tab second portion may comprise a through-hole large enough to allow an object having a major dimension of at least 3 mm to pass through, and in certain embodiments the through-hole may be large enough to allow passage of an object having a major dimension of at least 5 mm, for example a finger nail or similar object.

In certain system embodiments the lifting tab second portion may comprise an opaque region and a clear region. In certain of these embodiments, the opaque region may be proximal to the first portion, and the clear region distal to the first portion of the lifting tab, wherein the through-hole is surrounded by the opaque region.

In yet other system embodiments the first portion may comprise printed matter visible through the erasable sheet.

In certain other system embodiments the lifting tab may comprise a backing member having first and second major surfaces, print media on at least a portion of the first major surface of the first portion of the lifting tab, a substantially non-removable and transparent adhesive coating covering the print media and areas of the first major surface of the first portion of the lifting tab not having print media thereon, the first portion adhered to the underside of the erasable sheet by the adhesive layer.

In certain system embodiments, the frame, substrate sheet, media sheet, and erasable sheet may independently comprise materials selected from the group consisting of natural materials, synthetic materials, composite materials, and any combination of these. In certain system embodiments, the substrate sheet, media sheet, and erasable sheet may independently comprise one or more synthetic materials.

In certain system embodiments, the synthetic materials may be polymeric, such as thermoplastics, thermoplastic elastomers, thermosetting plastics, and the like, and the materials may contain one or more additives and/or coatings, such as fillers, coloring agents, pigments, and the like.

Examples of suitable thermoplastic materials include polyethylene, polypropylene, and the like. Hybrid or composite materials may be used for the substrate and media sheet, for example, polymer-coated cardboard, and the like.

For example, one or more of the frame, erasable sheet, media sheet, and substrate sheet may comprise one or more antireflective ("AR") coating(s), and/or anti-glare coating(s), and/or antimicrobial coating(s). The antireflective, anti-glare, and/or antimicrobial properties may be in the same or different coating layer(s), and may be in a variety of colors. Examples of antireflective coatings for plastic materials, such as polycarbonates, acrylics, polystyrene, and other plastic materials, as well as for glass, metals, and semiconductive materials are available, for example, on the Internet website of Evaporated Coatings Inc., Willow Grove, Pa., USA, such as their products marketed under the trade designations ECI#129, ECI#139, ECI#149, and ECI#149EX. It is believed these coatings are vacuum-deposited using one or more of the coating systems listed on their Internet website, such as thermal source, ion-assisted e-beam. Ton beam sputtering (TBS), magnetron sputtering and Leybold APS, although the present inventor is not an expert in these coatings, their formation, or their application to any particular materials. Also see U.S. Pat. Nos. 6,815,056; 6,528,142; and 5,763,061. Examples of anti-glare coatings in a variety of colors are provided on the Internet website of TSP, Inc., of Batavia, Ohio, USA, under the trade designation DURA VUE, available in a variety of gloss levels, all of which maintain scratch- and chemical-resistance. See also U.S. Pat. Nos. 7,128,428; 4,582,761; and 4,697,881. Examples of antimicrobial coatings for metals may be found on the Internet website of, for example, Plas-Tech Coatings, West Chester, Pa., USA, under the trade designation SILVER SHIELD, which are described as antimicrobial fluoropolymer coatings. Other suppliers manufacture antimicrobial coated films, such as the films and coatings marketed under the trade designation DUN-SHIELD, available from DUNMORE Corporation, Bristol, Pa., USA, which is believed to comprise either bulk silver, silver ions, or both in their coating formulations, possibly under license from Sciessent, Wakefield, Mass., USA. See also, U.S. Pat. Nos. 7,884,089; 6,706,855; and 7,955,636.

In certain system embodiments, at least one of the synthetic materials may be cardboard or paperboard.

In certain system embodiments, the lifting tab may comprise one or more puncturable areas configured to allow a fingernail or other user-directed object to puncture at least one of the puncturable areas and allow the user to grab the lifting tab.

Figure 2:
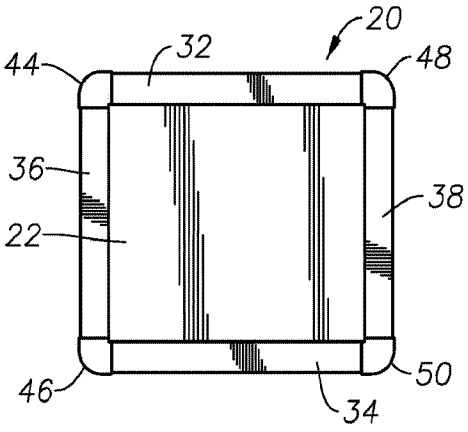
Fig. 2 (Prior Art)

Referring now to the drawing figures, FIGS. 1 and 2 are schematic plan views of two prior art frames suitable for use in the systems and kits of the present disclosure. Frame 10 illustrated schematically in FIG. 1 includes four cover members: a top cover member 12, a bottom cover member 14, a left side cover member 16, and a right side cover member 18, the four cover members acting with additional members to hold a substrate sheet 22 in frame 10 as will become more apparent herein. Cover members 12 and 16 meet at a mitered corner 24 when frame 10 is closed as illustrated. Similarly, cover members 14 and 16 meet at a mitered corner 26 when frame 10 is closed, cover members 12 and 18 meet at mitered corner 28, and cover members 14 and 18 meet at mitered corner 30. Cover members 12, 14, 16, and 18 are typically aluminum, while substrate sheet 22 may be a high-impact polystyrene sheet.

Frame 20 illustrated schematically in FIG. 2 also has four cover members: a top cover member 32, a bottom cover member 34, a left side cover member 36, and a right side cover member 38, but rather than mitered corners, has four molded corner pieces 44, 46, 48, and 50, and the ends of cover members 32, 34, 36, and 38 are not mitered. Rectangular frames 10 and 20 are available in many sizes from various online suppliers, such as under the trade name TRAPPA Snap Edge Poster Frames, from Tradeshowplus.com, StarExpo LTD., and others.

Figure 4:
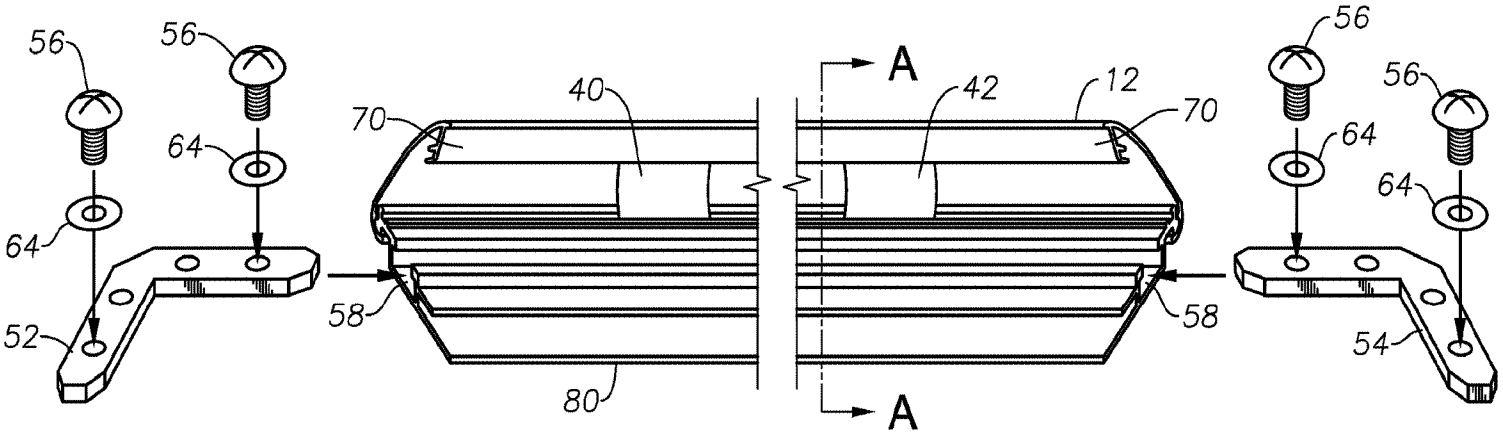
Fig. 4 (Prior Art)
FIGS. 3-6 are more detailed schematic views, with FIG. 4 being an exploded view, of portions of the frame schematically illustrated in FIG. 1.
Figure 3:
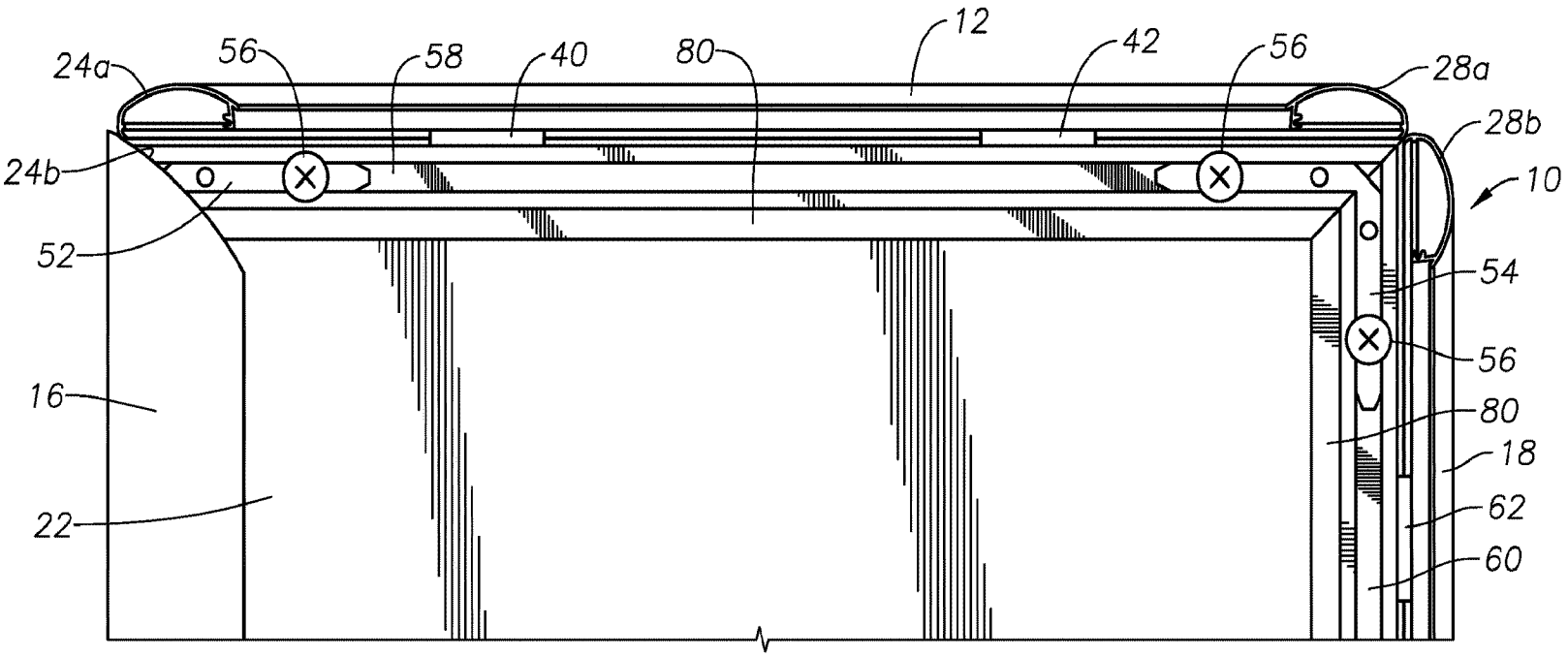
Fig. 3 (Prior Art)

FIGS. 3-6 are more detailed schematic views, with FIG. 4 being an exploded view, of portions of prior art frame 10 illustrated schematically in FIG. 1. More specifically, FIGS. 3 and 4 illustrate schematically two corner brackets 52, 54 that together with various screws 56 and washers 64 hold frame functional members 80 of frame 10 together. Frame 10 has four functional frame members 80, only two of which are viewable in FIG. 3. Each functional member 80 is hingedly connected to a cover member, as further explained herein. In FIG. 3, a pair of springs 40, 42 are illustrated holding up cover member 12, while a spring 62 is holding up cover member 18 along with another spring not viewable in FIG. 3 Cover member 16 is illustrated in its closed position (therefore its corresponding functional frame member 80 and springs are not viewable). One leg of corner bracket 52 resides in a trough 58 formed in functional member 80 associated with cover member 12, as does one leg of corner bracket 54. A second leg of corner bracket 54 resides in trough 60 formed in functional member 80 corresponding to cover member 18. FIG. 3 also illustrates edges 24*a*, 28*a* of open cover member 12, an edge 24*b* of closed cover member 16, and an edge 28*b* of open cover member 18.

Figure 5:
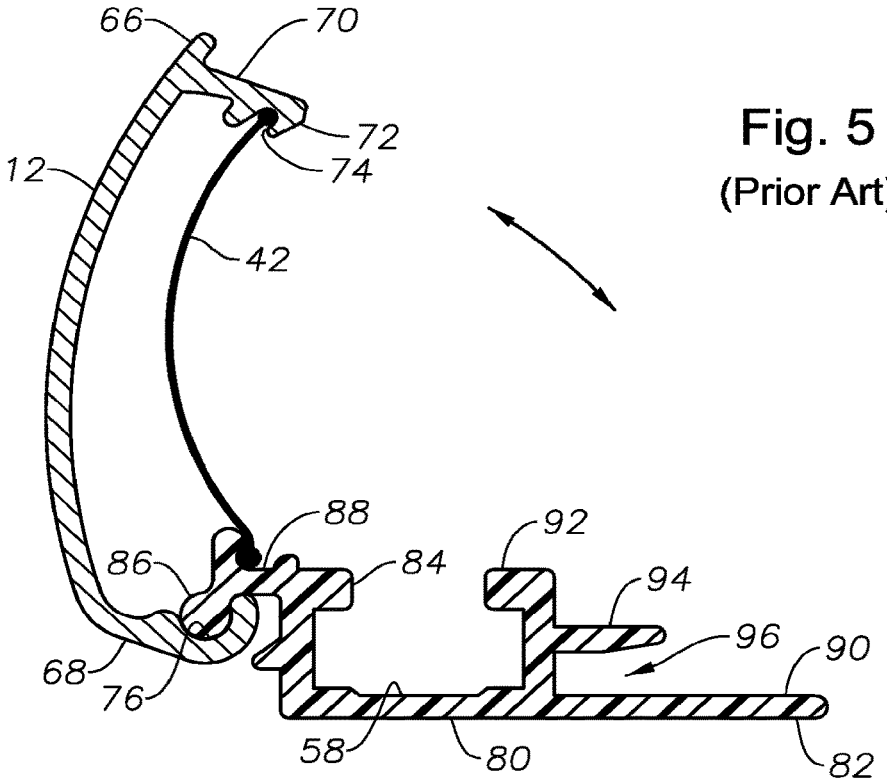
Fig. 5 (Prior Art)
Figure 8:
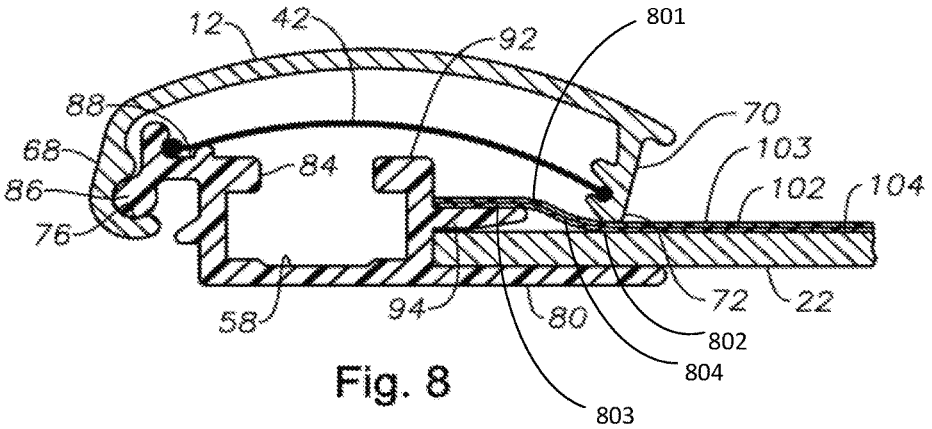
FIG. 8 is a schematic cross sectional view of a portion of the system embodiment of FIG. 7.

FIG. 5 is a schematic cross-sectional view taken along the line A-A in FIG. 4 illustrating cover member 12 in the open position. Cover member 12 has a distal end 66 and a proximal end 68, with cover member 12 hingedly attached to frame functional member 80 via a socket 76 pivotable around a cylindrical appendage 86 of functional member 80, as will be explained presently. Cover member distal end 66 includes a ridge 70 having a distal surface 72 and a slot 74, the latter accepting a distal end of spring 42. A proximal end of spring 42 is positioned in a slot 88 of a proximal end 84 of functional member 80. Proximal end 84 and a post extension 92 together form trough 58, previously illustrated in FIGS. 3 and 4. Post extension 92 supports a wing 94 that essentially provides a shelf on its top surface, while its bottom surface, along with top surface 90 of functional member 80 create a slot 96. Slot 96 accepts the substrate sheet, while the shelf created by wing 94 supports the media sheet and the erasable sheet, as illustrated in FIG. 8.

Figure 6:
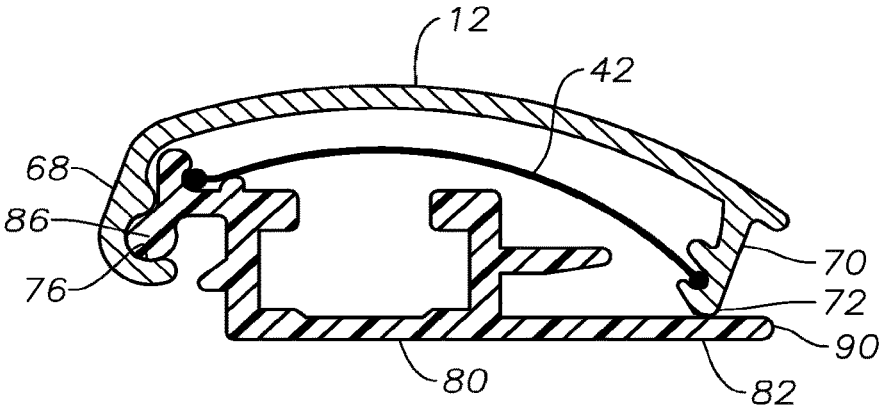
Fig. 6 (Prior Art)

FIG. 6 is a schematic cross-sectional view of the frame member illustrated in FIG. 5 in a closed position, illustrating how distal surface 72 of ridge 70 closes down upon surface 90 of functional frame member 80 near its distal end 82 when no substrate sheet, media sheet, or erasable sheet is present (in other words, before use in systems of the present disclosure). By virtue of spring 42 and other like springs, cover member 12 snaps closed with a significant holding force, and in certain instances even an audible "snap."

Figure 7:
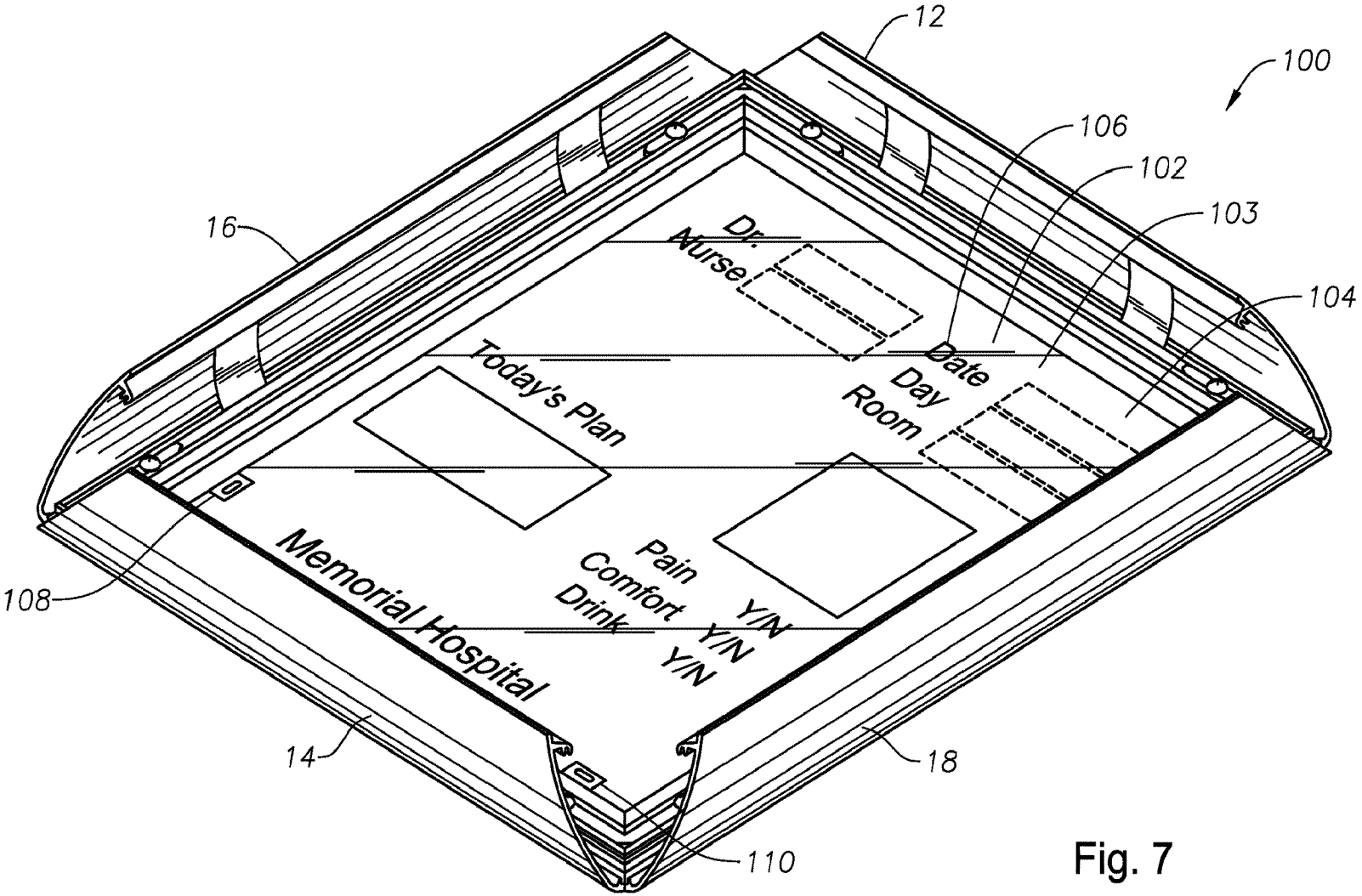
FIG. 7 is a schematic perspective view of a first system embodiment.

FIG. 7 is a schematic perspective view of a first system embodiment 100 in accordance with the present disclosure. In embodiment 100, a flexible erasable sheet 102 may include a top surface 103 adapted to a eraseably receive markings, such as typically found in a dry erase board or a wet erase board. In some embodiments, erasable sheet 102 may be transparent. Erasable sheet 102 is sized to fit within a holding space defined by post extensions 92 in each frame side, as illustrated in FIG. 8. Erasable sheet 102 may be comprised of one or more plastic materials, for example, but not limited to, polyvinylchloride (PVC), polycarbonate, acrylic, dry erase board or wet erase board materials known in the art. In some embodiments, erasable sheet 102 may be sanitizable and/or disinfectable, for example by heat, cleaning solutions, ultraviolet light, or combination thereof. Which cleaning solution to use depends on the composition of the erasable sheet, or at least the top erasable surface. Isopropyl alcohol, whether from a bottle, or in the form an alcohol wipe, will work to remove erasable ink from most white boards. Abrasive pads and cleaners having abrasives in them should be avoided. The use of permanent markers, such as those known under the trade name SHARPIE, should be avoided for writing on erasable sheet 102.

Referring again to FIG. 7, embodiment 100 includes a media sheet 104 underneath erasable sheet 102. Media sheet 104 has permanent, durable or temporary markings 106, which may indicate the name of the hospital or medical facility, its logo, the doctor's name, the nurse's name, an area for "Today's Plan" for the patient, date, day of the week, room number, pain information, comfort information, and other information. Erasable sheet 102 is positioned directly over media sheet 104, and both media sheet 104 and erasable sheet 102 are sized to fit within the holding space defined by post extensions 92 in each frame side, as illustrated in FIG. 8, with substrate sheet 22 underneath both and clamped into position by ridge 70. Ridge 70's distal surface 72 abuts top surface 103 of erasable sheet 102 at points away from the edge of sheet 102 and 104 a distance that may vary, depending on the size of frame being used, but generally ranges from about 0.5 to about 2.0 cm. The compression of sheet 102 and 104 in FIG. 8 may or may not be exaggerated, depending on the materials of the sheets. FIG. 8 depicts a parallel curvature 801 of the erasable sheet 102 and the media sheet 104. The parallel curvature 801 comprises an inner point 802 supported by the substrate base sheet 22, an outer point 803 supported by a top surface of the wing 94, and an inflection point 804 between the inner point 802 and the outer point 804. The inner point 802 is at a first distance above the substrate base sheet 22 and the second point is at a second distance above the substrate base sheet 22, the second distance being greater than the first. In some embodiments, media sheet 104 and erasable sheet 102 are substantially the same peripheral size.

In certain embodiments, erasable sheet 102 has flexibility similar to standard overhead projector sheets, but this is not necessarily so. While the thickness of commercially available overhead projector sheets may be difficult to ascertain, information is available from manufacturers of standard polyethylene terephthalate ("PET") polyester films such as those known under the trade designation MYLAR®, produced and commercially available from DuPont Tejjin Films. As explained by one supplier (Graphix Plastics, Inc., Cleveland, Ohio, USA), these films and sheets are available in thickness (sometimes referred to as "gauge") ranging from about 0.001 inch to about 0.030 inch (24 micrometers to 700 micrometers, or from about 0.0005 inch to about 0.014 inch (12 micrometers to 350 micrometers).

Media sheet 104 may be a visual graphic board, and may be customized for a variety of industries. Media sheet 104 may be comprised of virtually any natural or synthetic material able to accept temporary or permanent markings, including, but not limited to PYC, styrene (polystyrene) flexible polymeric materials, white board stock, paper, fabric, cork, dry erase board or wet erase board, leather, and the like. In some embodiments, media sheet 104 may be sanitizable and/or disinfectable, for example by heat, cleaning solutions, ultraviolet light, or combination thereof. Media sheet 104 may include a top surface adapted to have visual graphics printed thereon. In some embodiments, media sheet 104 may include a back surface (not shown) adapted to have visual graphics printed thereon. In certain embodiments media sheet may be flexible as a piece of standard 8.5×11 inch writing paper or newspaper, but this is not necessarily so.

Figure 9:
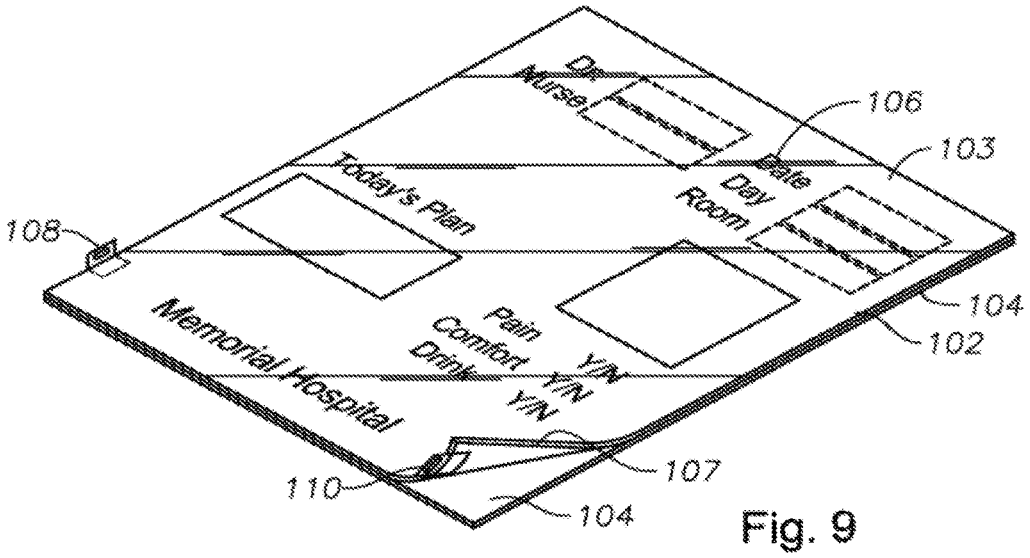
FIG. 9 is a schematic perspective view of a substantially transparent erasable sheet and a media sheet, showing certain features of systems of this disclosure.

Referring again to FIG. 7, an important aspect of the disclosure is the provision of one or more lifting tabs 108, 110 as will now be explained. When erasable sheet 102 and media sheet 104 are sized substantially the same, as in some embodiments, it may be very difficult to separate erasable sheet 102 from media sheet 104, for example, when the two sheets are to be separated when a user desires to change from a "used" erasable sheet 102 to a new one, or when a user wishes to change media sheet 104 by removing the existing one and replacing it with a new and/or different media sheet 104. One or more lifting tabs 108, 110 may be useful in these instances. FIG. 9 is a schematic perspective view of a substantially transparent erasable sheet 102 having an upturned portion 107 and a media sheet 104, illustrating certain features of systems of this disclosure, specifically the provision of lifting tabs 108, 110 a portion of which are adhered to the underside of erasable sheet 102.

Figure 10A:
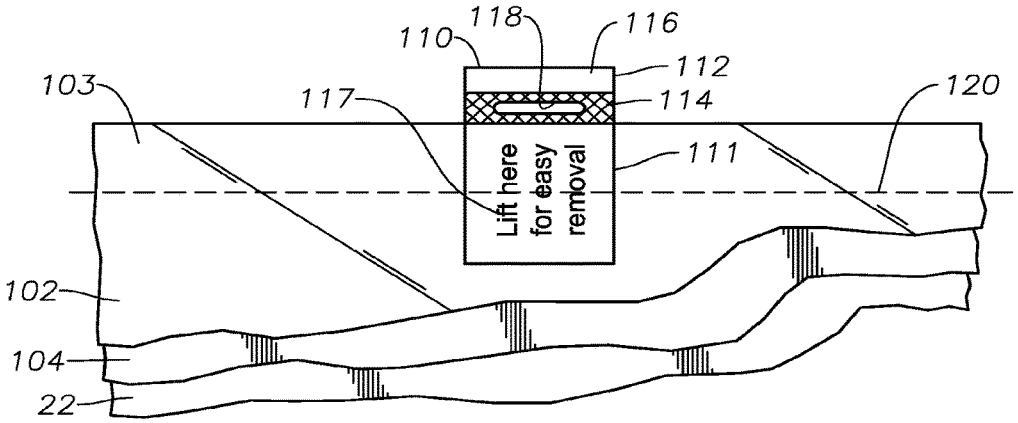
FIGS. 10A-10B are schematic plan views, with parts broken away.
Figure 10B:
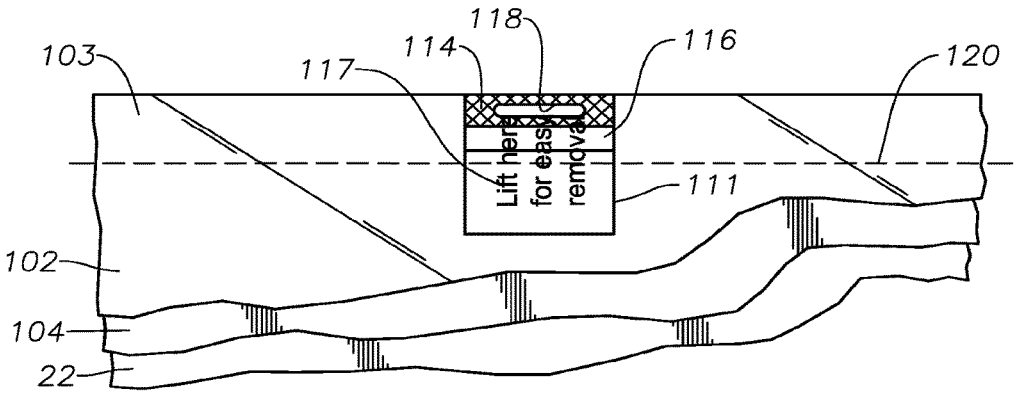

FIGS. 10A-10B are more detailed schematic plan views, with parts broken away, of one such lifting tab attached to the underside surface of erasable sheet 102. Lifting tab 110 has a size comparable to the known marker flags marketed by 3M Company (about 4 cm×2.5 cm), but this is not necessarily so. More specifically, a first portion or main body 111 of lifting tab 110 is adhered to the underside of erasable sheet 102, and may have viewable print 117 thereon, as more fully explained in reference to FIG. 10C, discussed presently. A non-attached second portion 112, referred to herein as a lifting tab extension, is also provided in this embodiment with an opaque region 114 and a transparent region 116. Opaque region 114 may have a through-hole 118 large enough to pass an object such as a fingernail, a handicapped person's gripper or hook, or tip of a screwdriver, or other such object. In certain embodiments through-hole 118 may have a major (length) dimension of at least 1 cm, or at least 2 cm, or at least 3 cm, or at least 5 cm, and minor dimension (width) ranging from 1 mm up to 1 cm, depending on the size of the lifting tab. In certain embodiments the lifting tab may have size much large than illustrated, depending on user needs. In certain embodiments through-hole 118 may be die-cut for added strength, and may be formed through a reinforced area of opaque region 114 (reinforcement provided for example by stronger plastic, or increased thickness). Dashed line 120 illustrates about where the ridge 70 and its distal surface 72 would abut against the top surface 103 of erasable sheet 102 using a frame known under the trade designation TRAPPA. Note that from FIG. 10B, opaque region 114 and transparent region 116 would not be viewable when the frame is closed.

Figure 10C:
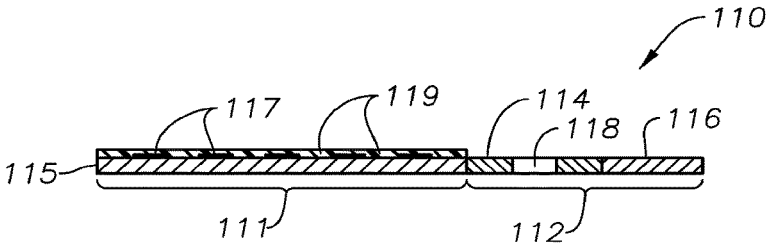
FIG. 10C is a cross-sectional view, of a non-integral lifting tab in accordance with the present disclosure.

FIG. 10C is a cross-sectional view of a non-integral lifting tab 110 in accordance with the present disclosure. By "non-integral" is simply meant that the user of the system would apply the lifting tab to the sheet, whereas "integral" means that the lifting tab is a part of the sheet (either the erasable sheet or the media sheet) as manufactured and the user need do nothing, as in embodiment 250 illustrated schematically in FIG. 12. Illustrated in FIG. 10C are main body 111, tab extension 112 having opaque region 114 (with through-hole 118) and transparent region 116. Also illustrated are a backing 115 which is illustrated as forming part of main body 111, and in certain embodiments may extend and form part of tab extension 112. Backing 115 supports print areas (ink or other material) 117 and adhesive 119. Adhesive 119 fills in between print areas 117 and also covers print areas 117 to provide a continuous surface of adhesive, which serves to adhere lifting tab main body 111 to the underside of an erasable sheet 102 or a media sheet 104. Print areas 117 need not be as durable and permanent as alluded to above for certain media sheets, as adhesive layer 119 will partially protect the print.

Figure 11:
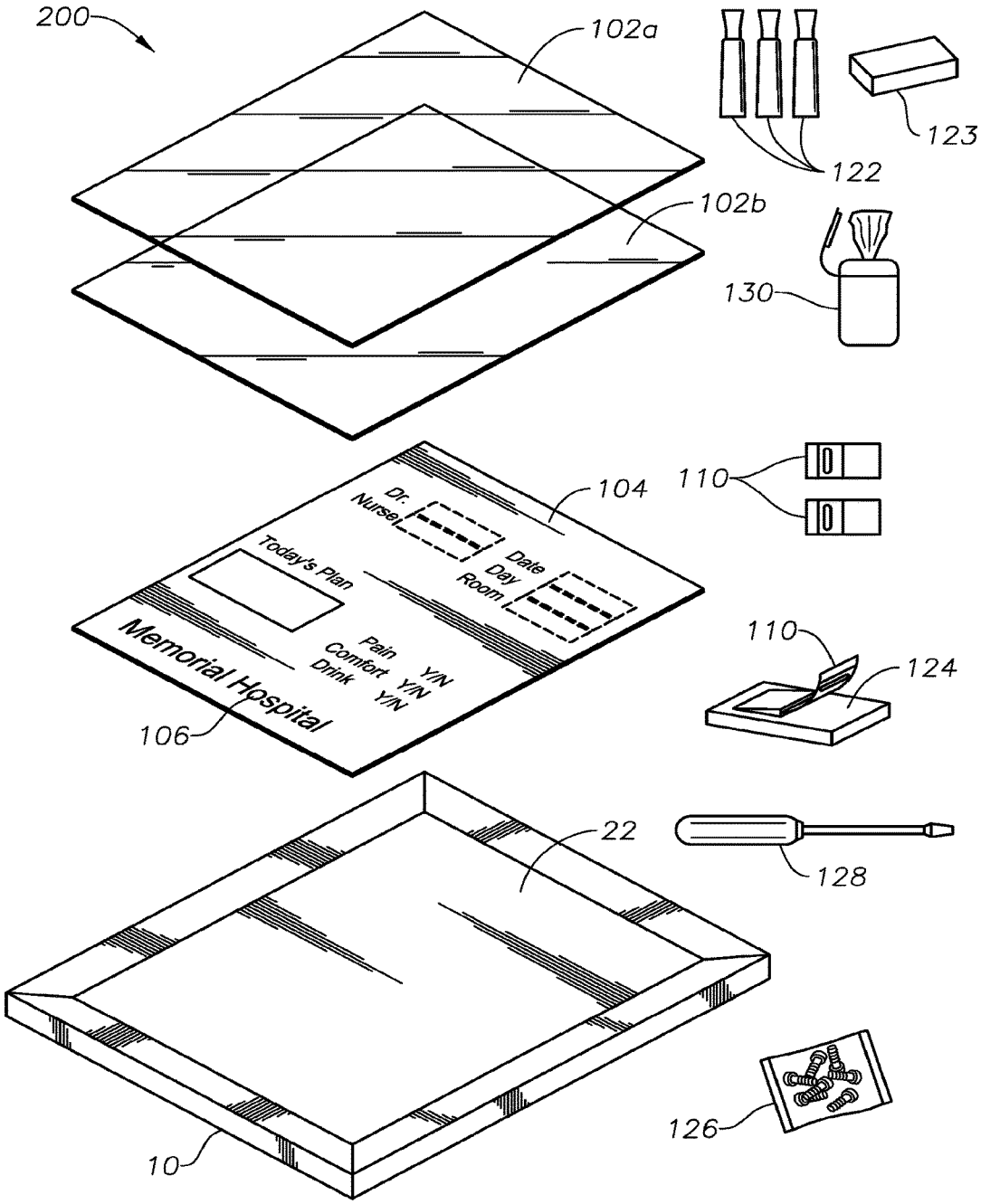
FIG. 11 is a schematic perspective view of a kit in accordance with the present disclosure.

FIG. 11 is a schematic perspective view of one possible kit embodiment 200 in accordance with the present disclosure. Embodiment 200 includes two flexible, plastic, transparent erasable sheets 102*a* and 102*b*, a media sheet 104, a frame 10 with substrate sheet 22, and a set of lifting tabs 110 and a dispenser 124 for lifting tabs. Optional items of kits within this disclosure may include a set of erasable markers 122 and eraser 123, a small screw driver 128 and bag 126 of screws and plastic hole mounts, the latter typically shipped with frame 10, and a container of alcohol wipes. Optionally, a second or more media sheets could be provided, either identical to media sheet 104, or different, for example having different medical specialties in the same facility, or in a different language.

Figure 12:
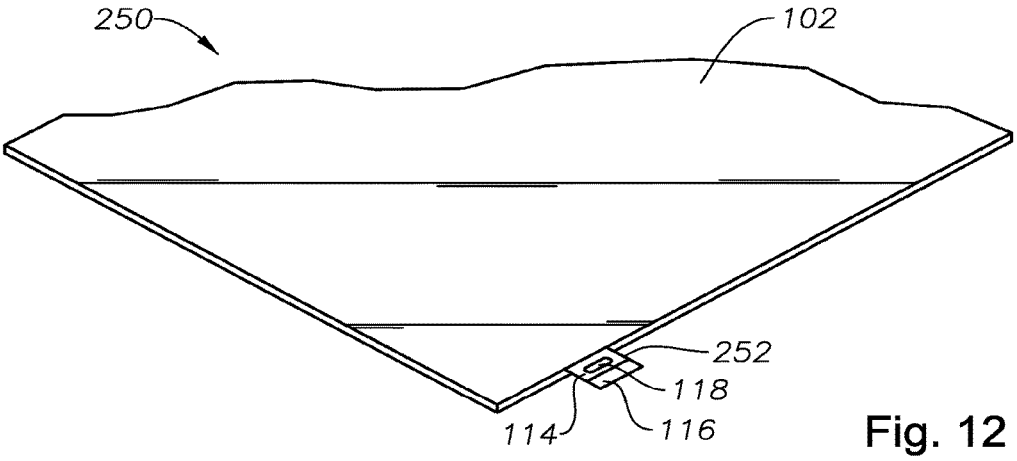
FIG. 12 is a perspective view of a substantially transparent erasable sheet having an integral lifting tab according to another embodiment of the present disclosure.

FIG. 12 is a perspective view of an embodiment 250 of a substantially transparent erasable sheet 102 having an integral lifting tab 252 according to another embodiment of the present disclosure. Lifting tab 252 may be molded and die-cut when sheet 102 is die-cut, and may include an opaque region 114 having a die-cut through-hole, and a transparent region 116, as in previous lifting tab embodiments.

Figure 13B:
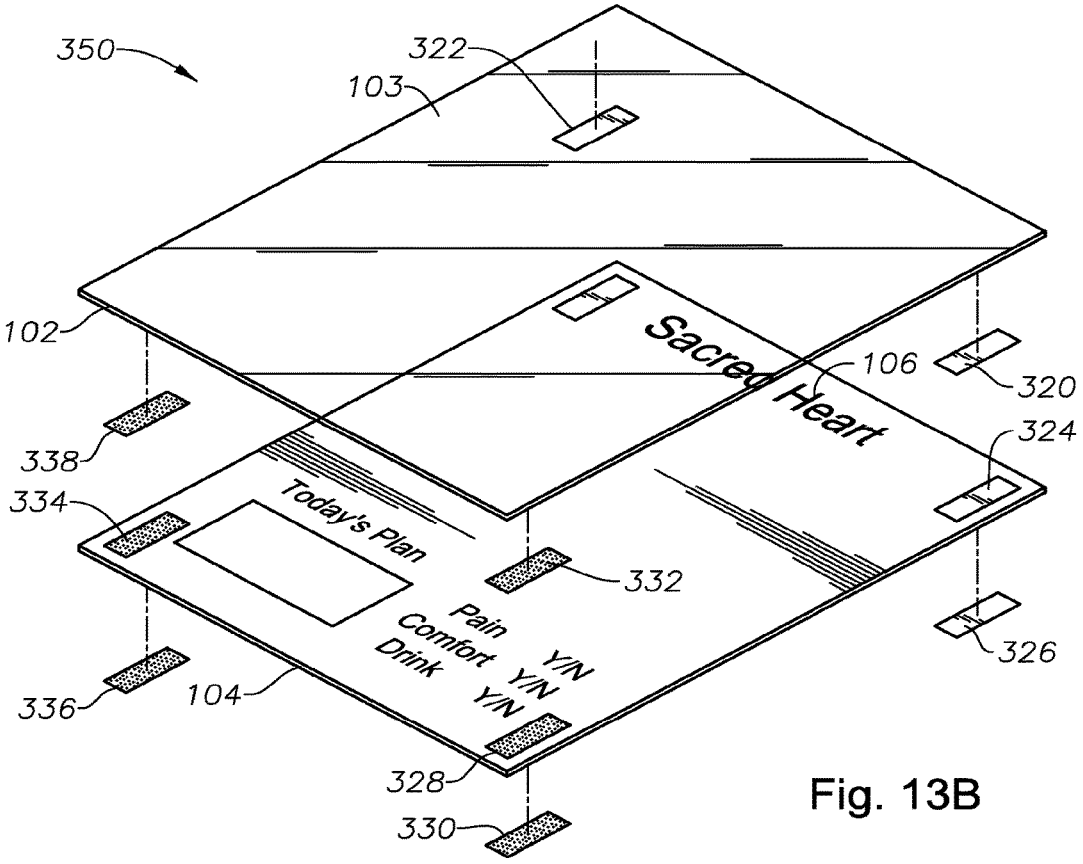
FIGS. 13A and 13B are schematic perspective views of other systems and in accordance with this disclosure.
Figure 13A:
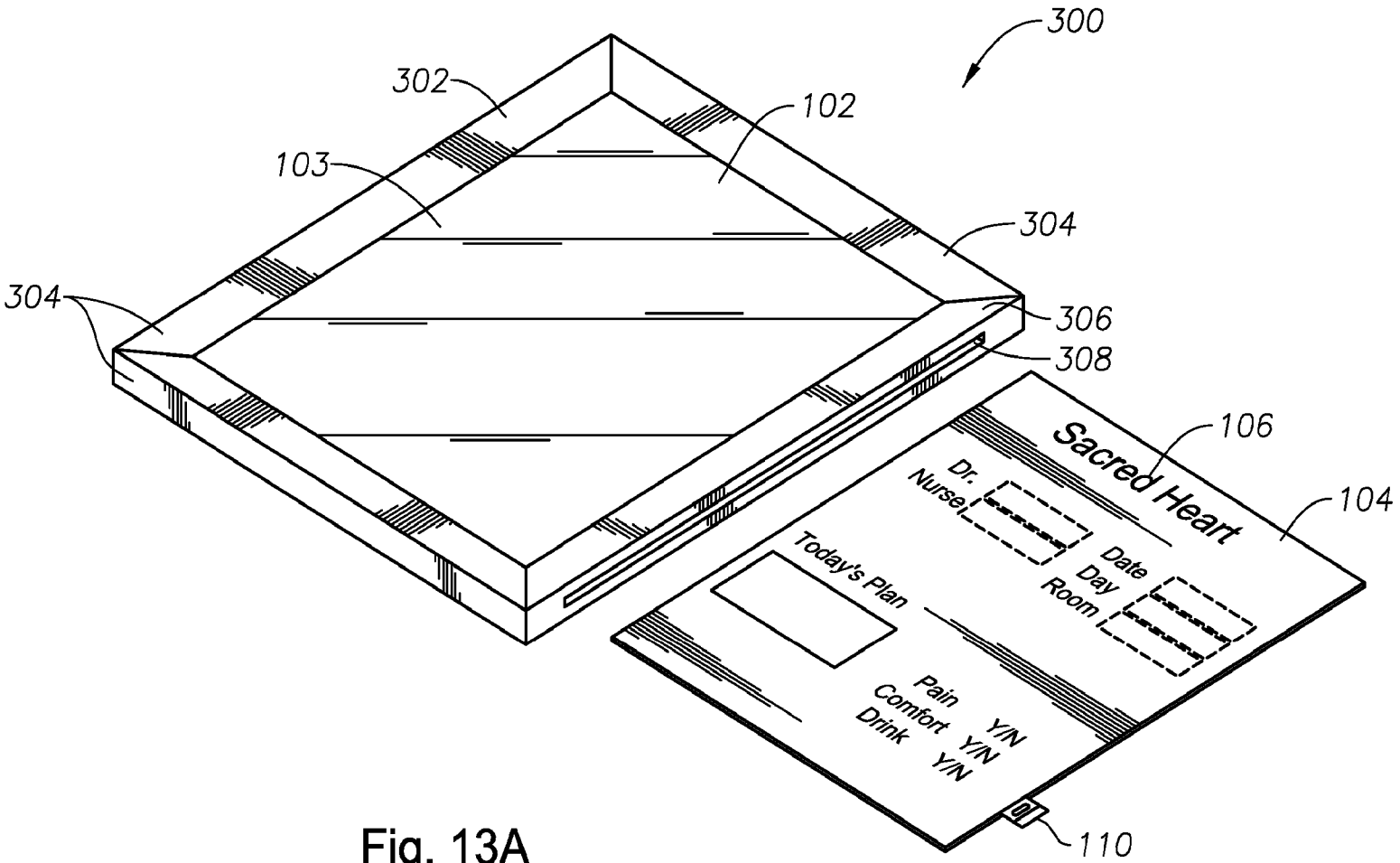

FIGS. 13A and 13B are schematic perspective views of other systems in accordance with this disclosure. Embodiment 300 illustrated schematically in FIG. 13A, includes a frame 302 having three similar sides 304, and a fourth side 306 having a slot 308 allowing insertion and removal of a media sheet 104. In embodiment 300, erasable sheet 102 is permanently placed in frame 302, but this is not necessarily so, as both media sheet 104 and erasable sheet 102 could be insertable into and removable from such a frame. Optionally, a lifting tab 110 could be added to either sheet. In embodiment 300 a lifting tab 110 is illustrated attached to media sheet 104. Media sheet 104 (and erasable sheet 102 in certain embodiments) may be slid into slot 308 and aided by grooves, channels, or other guiding features (not illustrated) in sides 304.

FIG. 13B schematically illustrates another embodiment 350, which comprises no frame per se, but rather an erasable sheet 102 and a media sheet 104 attached via magnets and/or hook and loop fasteners to each other and adapted to be so attached to a wall or other structure (not shown). For example, magnets 320 and 322 could be positioned on the underside of erasable sheet 102, and adhered thereto with adhesive. Magnet 320 would interact with a magnet having opposite polarity 324 fastened to media sheet 104, and another magnet 326 could serve to attach to a magnetic wall or other support structure. Hook and loop fasteners could be used as well rather than, or in addition to, magnets in certain embodiments. For example, embodiment 350 illustrates use of one half of hook and loop fasteners 332, 338 positioned near the bottom, underneath side of erasable sheet 102, with piece 332 mating with its mating sheet 328, and piece 338 mating with piece 334, both 328 and 334 adhered to the top side of media sheet 104. Finally, two other sets of hook and loop fasteners, 330, 336, would mate with pieces on a wall or other structure.

The various embodiments of the disclosure allow consumers or commercial users flexibility, for example when it is necessary to change an erasable sheet or media sheet for a scheduled or unscheduled event, such as a new patient or new doctor, change of room, or other change. Other uses of systems and kits described herein no doubt will come to the minds of consumers and commercial users, and those end uses of systems and kits described herein are considered within the present disclosure.

For example, certain system and kit embodiments may include, as another customizable and functional element, one or more sticky gel-backed fabric icons which are movable and removably adhere to the erasable sheet or lens, for instance to denote that a patient wears dentures or contact lenses. In certain instances, medical personnel such as nurses and doctors may not want the patient to see the word "dentures", or the patient may not want to see this or some other particular word. In these embodiments, a custom "D" or "d" may be printed on a round, square or rounded square or rectangle or polygon shape fabric icon. In certain embodiments these may have the advantages of being disposable, temporary, changeable per patient, and sanitary. They may be used similar to a magnet but are not magnetic. If the sticky gel backing becomes dull and is not as tacky as when first used, they may be simply rinsed off with water and the gel is fully tacky again. The fabric top layer may comprise a microfiber material, but may be any other fabric or antimicrobial fabric. The fabric may be used as an eraser to wipe off the markings written on the erasable sheet. These sticky gel-backed fabric icons may be used for confidentiality uses, where a person may want a symbol to be added that the nurses recognize but is not obvious to the general public or the patient. This same item may be created larger and used as an eraser, similar in shape to typical erasers (rectangle or other shape).

Although the foregoing detailed description is intended to be representative of the disclosure, it is not intended to in any way limit the scope of the appended claims.

I claim:

1. A planar display communication board comprising:

a frame having a plurality of sides, at least one of the plurality of sides including a cover member hingedly connected to a functional member, the cover member having a raised position and a closed position, and the functional member including:

a slot formed by (i) a top surface of the functional member, (ii) a post extension that extends from the top surface, and (iii) a first surface of a wing that extends from the post extension parallel to the top surface; and a shelf formed by (i) the post extension and (ii) a second surface of the wing, the second surface of the wing opposing the first surface of the wing;

a substrate base sheet held within the slot of the functional member; and an erasable sheet positioned directly over a flexible media sheet and supported by the shelf, such that:

when the cover member is in the raised position, the erasable sheet and the flexible media sheet abut for alignment against the post extension; and when the cover member is in the closed position, the cover member compresses the erasable sheet and the flexible media sheet against the substrate base sheet away from at least one edge of the erasable sheet and the flexible media sheet.

2. The planar display communication board of claim 1, wherein at least one cover member comprises a spring that causes the at least one cover member to snap from the raised position to the closed position.

3. The planar display communication board of claim 1, wherein the flexible media sheet comprises a thermoplastic polymeric flexible media sheet.

4. The planar display communication board of claim 1, wherein the erasable sheet comprises a substantially transparent flexible erasable sheet.

5. The planar display communication board of claim 1, wherein both the flexible media sheet and the erasable sheet comprise the same length and width dimensions.

6. The planar display communication board of claim 1, wherein the compression retains an interior portion of the erasable sheet in a planar configuration.

7. The planar display communication board of claim 1, wherein the compression further creates a parallel curvature of the erasable sheet and the flexible media sheet, the parallel curvature having an inner point supported by the substrate base sheet, an outer point supported by the second surface of the wing, and an inflection point between the inner point and the outer point.

8. The planar display communication board of claim 7, wherein the inner point is a first distance from the substrate base sheet, the outer point is a second distance from the substrate base sheet, and the second distance is greater than the first.

9. The planar display communication board of claim 1, wherein the flexible media sheet comprises at least one lifting tab extending away from a peripheral edge of the flexible media sheet.

10. The planar display communication board of claim 9, wherein the lifting tab is adhered to the flexible media sheet.

11. A planar display communication board kit comprising:

a frame having a plurality of sides, at least one of the sides including a cover member hingedly connected to a functional member, the cover member having a raised position and a closed position, and the functional member including:

a slot formed by (i) a top surface of the functional member, (ii) a post extension that extends from the top surface, and (iii) a first surface of a wing that extends from the post extension parallel to the top surface; and a shelf formed by (i) the post extension and (ii) a second surface of the wing, the second surface of the wing opposing the first surface of the wing; and a substrate base sheet held within the slot of the functional member; such that:

the communication board kit is configured to receive an erasable sheet positioned over a flexible media sheet;

when the cover members are in the raised position, the erasable sheet and the flexible media sheet are supported by the shelf and abut for alignment against the post extension; and when the cover members are in the closed position, the cover member compresses the erasable sheet and the flexible media sheet against the substrate base sheet away from at least one edge of the erasable sheet and the flexible media sheet.

12. The planar display communication board kit of claim 11, wherein at least one cover member comprises a spring that causes the at least one cover member to snap from the raised position to the closed position.

13. The planar display communication board kit of claim 11, wherein the flexible media sheet comprises a thermoplastic polymeric flexible media sheet.

14. The planar display communication board kit of claim 11, wherein the erasable sheet comprises a substantially transparent flexible erasable sheet.

15. The planar display communication board kit of claim 11, wherein both the flexible media sheet and the erasable sheet comprise the same length and width dimensions.

16. The planar display communication board kit of claim 11, wherein the compression retains an interior portion of the erasable sheet in a planar configuration.

17. The planar display communication board kit of claim 11, wherein the compression further creates a parallel curvature of the erasable sheet and the flexible media sheet, the parallel curvature having an inner point supported by the substrate base sheet, an outer point supported by the second surface of the wing, and an inflection point between the inner point and the outer point.

18. The planar display communication board kit of claim 17, wherein the inner point is a first distance from the substrate base sheet, the outer point is a second distance from the substrate base sheet, and the second distance is greater than the first.

19. The planar display communication board kit of claim 11, wherein the flexible media sheet comprises at least one lifting tab extending away from a peripheral edge of the flexible media sheet.

20. The planar display communication board kit of claim 19, wherein the lifting tab is adhered to the flexible media sheet.

* * * * *